US008746686B2

(12) United States Patent
Tamehira et al.

(10) Patent No.: US 8,746,686 B2
(45) Date of Patent: Jun. 10, 2014

(54) REVERSING SHEET TRANSPORT APPARATUS AND IMAGE FORMING APPARATUS INCLUDING REVERSING SHEET TRANSPORT APPARATUS

(75) Inventors: Masato Tamehira, Osaka (JP); Yasumasa Morimoto, Osaka (JP); Kenji Kuroda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/610,458

(22) Filed: Sep. 11, 2012

(65) Prior Publication Data

US 2013/0069300 A1 Mar. 21, 2013

(30) Foreign Application Priority Data

Sep. 20, 2011 (JP) ..... 2011-205019

(51) Int. Cl.
*B65H 85/00* (2006.01)

(52) U.S. Cl.
USPC ..... 271/186; 271/184; 399/364; 399/374

(58) Field of Classification Search
USPC ..... 271/184, 186; 399/364, 372, 373, 374
See application file for complete search history.

(56) References Cited

U.S. PATENT DOCUMENTS

| | | | | |
|---|---|---|---|---|
| 5,689,793 | A * | 11/1997 | Kobayashi et al. | 399/374 |
| 5,771,058 | A * | 6/1998 | Kobayashi | 347/218 |
| 6,209,861 | B1 * | 4/2001 | Kakuta et al. | 271/3.02 |
| 6,814,353 | B1 * | 11/2004 | Kakuta et al. | 271/186 |
| 7,717,423 | B2 * | 5/2010 | Litman et al. | 271/273 |
| 2004/0140606 | A1 * | 7/2004 | Kobayashi et al. | 271/4.01 |
| 2007/0065197 | A1 * | 3/2007 | Tanaka | 399/374 |
| 2010/0054833 | A1 | 3/2010 | Hanamoto | |

FOREIGN PATENT DOCUMENTS

| | | | |
|---|---|---|---|
| JP | 2002-60095 | A | 2/2002 |
| JP | 2010-52848 | A | 3/2010 |

* cited by examiner

*Primary Examiner* — Stefanos Karmis
*Assistant Examiner* — Ernesto Suarez
(74) *Attorney, Agent, or Firm* — Birch, Stewart, Kolasch & Birch, LLP

(57) ABSTRACT

When a first elapse time Δt3 from time point t1 of stop of a transport motor reaches a first specified time S1, a registration roller electromagnetic clutch is engaged. At time point t2 at which the first elapse time Δt3 reaches 50 ms, normal rotation of the transport motor is started. At time point t3 at which a second elapse time Δt4 from the time point t2 reaches a second specified time S2 (a given length of time), a reverse roller electromagnetic clutch is switched from an engaged state to a disengaged state, rendering reverse rollers and sheet discharge rollers freely rotatable. At subsequent time point t4, a coil of a solenoid is de-energized, to separate the reverse rollers from each other.

14 Claims, 11 Drawing Sheets

FIG.12

| Size, Basis weight | A4 200g | | | | | |
|---|---|---|---|---|---|---|
| Pixel density | 400dpi | | | 600dpi | | |
| No. of times | First | Second | Third | First | Second | Third |
| S2=0ms | 10 | 10 | 10 | 10 | 10 | 10 |
| S2=5ms | 1 | 1 | 0 | 0 | 1 | 1 |
| S2=10ms | 0 | 0 | 0 | 0 | 0 | 0 |
| S2=20ms | 0 | 0 | 0 | 0 | 0 | 0 |
| S2=30ms | 0 | 0 | 0 | 0 | 0 | 0 |

REVERSING SHEET TRANSPORT APPARATUS AND IMAGE FORMING APPARATUS INCLUDING REVERSING SHEET TRANSPORT APPARATUS

CROSS-REFERENCE TO RELATED APPLICATION

This application claims priority under 35 U.S.C. §119(a) on Patent Application No. 2011-205019 filed on Sep. 20, 2011, the disclosure of which is hereby incorporated by reference in its entirely.

BACKGROUND OF THE INVENTION

1. Field of the Invention

The present invention relates to a reversing sheet transport apparatus capable of reversing the side of a sheet of paper and an image forming apparatus including such a reversing sheet transport apparatus.

2. Description of the Related Art

In the above type of reversing sheet transport apparatus, transport of a sheet of paper by registration rollers is started after an edge of the sheet is hit against the registration rollers that are at a temporary stop and aligned. In the case of reversing the side of the sheet, reverse rollers are once stopped and then rotated in the reverse direction midway through the transport of the sheet by the reverse rollers, to transport the sheet back to the registration rollers through a reverse transport path by the reverse rollers. An edge of the sheet is hit again against the registration rollers that are at a temporary stop, and then the sheet is transported again by the registration rollers.

For example, in JP 2002-60095A, switch-back rollers (corresponding to the reverse rollers) are rotated in the reverse direction midway through the transport of an original by the switch-back rollers, to transport the original to the registration rollers through a return path (corresponding to the reverse transport path) by the switch-back rollers. An edge of the original is hit again against the registration rollers that are at a temporary stop, and then the original is transported again by the registration rollers, thereby revering the side of the original.

Such a reversing sheet transport apparatus is provided with an electromagnetic clutch that conveys or shuts off the rotation of a motor to the registration rollers, and the registration rollers are temporarily stopped by disengaging the electromagnetic clutch.

In some reversing sheet transport apparatuses, both the registration rollers and the reverse rollers are rotated by a single motor. In this case, in order to reverse the side of a sheet of paper, the rotation of the motor is reversed to rotate the reverse rollers in the reverse direction, to allow the reverse rollers to send the sheet back to the registration rollers through the reverse transport path. Thereafter, the motor is rotated normally, to allow the registration rollers to transport the sheet again. However, at the time of start of re-transport of the sheet by the registration rollers, the sheet still partly lies on the reverse rollers. Therefore, when the motor is rotated normally to allow both the reverse rollers and the registration rollers to rotate in the same direction, the sheet is pulled back by the reverse rollers with an edge of the sheet separating from the registration rollers. To address this problem, another electromagnetic clutch is provided to permit or block conveyance of the rotation of the motor to the reverse rollers, and the electromagnetic clutch for the reverse rollers is disengaged (when the reverse rotation of the motor is stopped, for example) to render the reverse rollers freely rotatable temporarily.

However, when a sheet of paper is thick and rigid, the reverse rollers tend to drag the sheet when the electromagnetic clutch for the reverse rollers is disengaged. Therefore, the sheet is pushed back toward the reverse rollers due to the elastic force of the sheet that has hit against the registration rollers and bent. This results in separation of the edge of the sheet from the registration rollers in a short period of time before the registration rollers restart transport of the sheet, causing jamming.

In JP 2002-60095A mentioned above, in which a motor for switch-back rollers is provided in addition to the motor for the registration rollers, it is unnecessary to provide an electromagnetic clutch for the switch-back rollers separately. However, the provision of two exclusive motors increases the scale of the apparatus and complicates the apparatus, increasing the cost of the apparatus.

SUMMARY OF THE INVENTION

An objective of the present invention is to provide a reversing sheet transport apparatus having a configuration in which the registration rollers and the reverse rollers are rotated by a single motor, and in which when a sheet of paper is transported from reverse rollers to registration rollers, the sheet is prevented from being pushed back toward the reverse rollers due to the elastic force of the sheet that has hit against the registration rollers and bent, and an image forming apparatus including such a reversing sheet transport apparatus.

The reversing sheet transport apparatus of the present invention includes: registration rollers configured to transport a sheet of paper after an edge of the sheet has hit against the registration rollers; reverse rollers configured to transport the sheet, placed downstream of the registration rollers in a sheet transport direction; a single transport motor configured to rotationally drive the registration rollers and the reverse rollers; a registration roller clutch configured to permit or block conveyance of rotation of the transport motor to rotation of the registration rollers; and a reverse roller clutch configured to permit or block conveyance of rotation of the transport motor to rotation of the reverse rollers, the transport motor being switched from normal rotation to reverse rotation midway through transport of the sheet in the sheet transport direction by the reverse rollers, to transport the sheet back to the registration rollers by the reverse rollers, and then being switched from reverse rotation to normal rotation to transport the sheet again in the sheet transport direction by the registration rollers, wherein the apparatus further includes a control section configured to switch the registration roller clutch from a disengaged state to an engaged state during switching of the transport motor from reverse rotation to normal rotation, and switch the reverse roller clutch from the engaged state to the disengaged state after the lapse of a given length of time from a time point of start of normal rotation of the transport motor.

In such a reversing sheet transport apparatus, the registration roller clutch is switched from the disengaged state to the engaged state during the switching of the transport motor from reverse rotation to normal rotation. Therefore, when the transport motor is rotating reversely, during which the registration roller clutch is in the disengaged state, the registration rollers are at rest, and the edge of the sheet of paper that has been transported by the reverse rollers abuts against the registration rollers and is aligned. Thereafter, when the transport motor starts normal rotation, at which the registration roller clutch is in the engaged state, the registration rollers rotate, and the sheet is transported again in the sheet transport direction by the registration rollers.

Also, when a given length of time has passed from the time point of start of normal rotation of the transport motor, the reverse roller clutch is switched from the engaged state to the disengaged state. Note that, even though the transport motor is switched from reverse rotation to normal rotation, the reverse rollers and the registration rollers do not start their rotation, or rotate at a low speed, immediately after the start of the normal rotation. This is because a time lag occurs from the time point of start of normal rotation of the transport motor until start of rotation of the reverse rollers and the registration rollers, or until rise of the rotational speed of the reverse rollers and the registration rollers. In view of this, the reverse roller clutch is switched from the engaged state to the disengaged state only after a given length of time has passed from the time point of start of normal rotation of the transport motor, at which transport of the sheet by the registration rollers has been started with reliability. Accordingly, roughly simultaneously with the start of transport of the sheet by the registration rollers, the reverse rollers are rendered freely rotatable. As a result, transport of even a rigid sheet by the registration rollers is started without the sheet being pushed back toward the reverse rollers due to the elastic force of the sheet that has hit against the registration rollers and bent, and the sheet is rapidly pulled out from the reverse rollers.

In the reversing sheet transport apparatus of the present invention, the given length of time may correspond to the time from the time point of start of normal rotation of the transport motor until start of rotation of the reverse rollers.

Backlash occurs in pulleys, belts, gears, etc. used for conveying the rotation of the transport motor to the reverse rollers. This causes a time lag from the time point of start of normal rotation of the transport motor until start of rotation of the reverse rollers. The given length of time is therefore set to correspond to the time lag.

In the reversing sheet transport apparatus of the present invention, when the reverse roller clutch is in the disengaged state, the reverse rollers may drag the sheet being transported.

This facilitates pulling of the sheet out from the reverse rollers.

In the reversing sheet transport apparatus of the present invention, the registration rollers may transport the sheet through a sheet transport path toward the reverse rollers in the sheet transport direction, the reverse rollers may transport the sheet through a reverse transport path toward upstream of the registration rollers in the sheet transport direction, and the registration rollers may transport again the sheet through the sheet transport path toward the reverse rollers in the sheet transport direction, to reverse the side of the sheet.

By sending the sheet back to the registration rollers through the reverse transport path and subsequently transporting the sheet again through the sheet transport path as described above, the side of the sheet can be reversed.

In the reversing sheet transport apparatus of the present invention, the reverse rollers may include a drive roller and an idler roller, the apparatus may further include a switching drive section configured to switch either one of the drive roller and the idler roller between a pressed state against the other roller and a separated state from the other roller, and the control section may control the switching drive section to switch the reverse rollers from the pressed state to the separated state simultaneously with or after the switching of the reverse roller clutch from the engaged state to the disengaged state.

By switching the reverse rollers from the pressed state to the separated state simultaneously with or after the switching of the reverse roller clutch from the engaged state to the disengaged state as described above, pulling of the sheet out from the reverse rollers is facilitated.

The reversing sheet transport apparatus of the present invention may further includes: sheet discharge rollers configured to transport the sheet at positions downstream of the reverse rollers in the sheet transport direction; and a rotation conveying section configured to convey rotation of the reverse rollers to rotation of the sheet discharge rollers.

In the configuration of placing the sheet discharge rollers at positions downstream of the reverse rollers in the sheet transport direction as described above, when a long sheet is transported back to the registration rollers by the sheet discharge rollers and the reverse rollers, the sheet still lies on the reverse rollers and the sheet discharge rollers. Therefore, the sheet must be pulled out from, not only the reverse rollers, but also the sheet discharge rollers, roughly simultaneously with start of transport of the sheet by the registration rollers. To achieve this, the rotation of the reverse rollers is conveyed to the sheet discharge rollers via a rotation conveying section. With this configuration, when the reverse roller clutch is switched from the engaged state to the disengaged state, rendering the reverse rollers freely rotatable, the sheet discharge rollers are also rendered freely rotatable. Thus, the sheet can be pulled out from, not only the reverse rollers, but also the sheet discharge rollers.

In the reversing sheet transport apparatus of the present invention, a stop period during which the transport motor is at rest may be provided between the reverse rotation and the normal rotation of the transport motor, and the control section may switch the registration roller clutch from the disengaged state to the engaged state during the stop period.

The stop period of the transport motor is set to stabilize the operation of the transport motor. By switching the registration roller clutch from the disengaged state to the engaged state during this stop period, the registration rollers can be rotated immediately at the start of rotation of the transport motor.

The image forming apparatus of the present invention includes the reversing sheet transport apparatus described above, wherein an original or a recording sheet is transported by the reversing sheet transport apparatus.

In such an image forming apparatus of the present invention, also, actions and effects similar to those of the reversing sheet transport apparatus of the present invention can be obtained.

According to the present invention, when the transport motor is rotating reversely, during which the registration roller clutch is in the disengaged state, the registration rollers are at rest, and the edge of the sheet that has been transported by the reverse rollers abuts against the registration rollers and is aligned. Thereafter, when the transport motor starts normal rotation, at which the registration roller clutch is in the engaged state, the registration rollers rotate, and the sheet is transported again in the sheet transport direction by the registration rollers. Also, the reverse roller clutch is switched from the engaged state to the disengaged state only after a given length of time has passed from the time point of start of normal rotation of the transport motor, at which transport of the sheet by the registration rollers has been started with reliability. Accordingly, roughly simultaneously with the start of transport of the sheet by the registration rollers, the reverse rollers are rendered freely rotatable. As a result, transport of even a rigid sheet by the registration rollers is started without the sheet being pushed back toward the reverse rollers due to the elastic force of the sheet that has hit against the registration rollers and bent, and the sheet is rapidly pulled out from the reverse rollers.

BRIEF DESCRIPTION OF THE DRAWINGS

FIG. 12 is a diagram showing experiment data on the numbers of occurrences of jamming obtained by changing the timing of switching of the reverse roller electromagnetic clutch from the engaged state to the disengaged state.

DESCRIPTION OF THE PREFERRED EMBODIMENT

An embodiment of the present invention will be described hereinafter with reference to the accompanying drawings.

Figure 1:
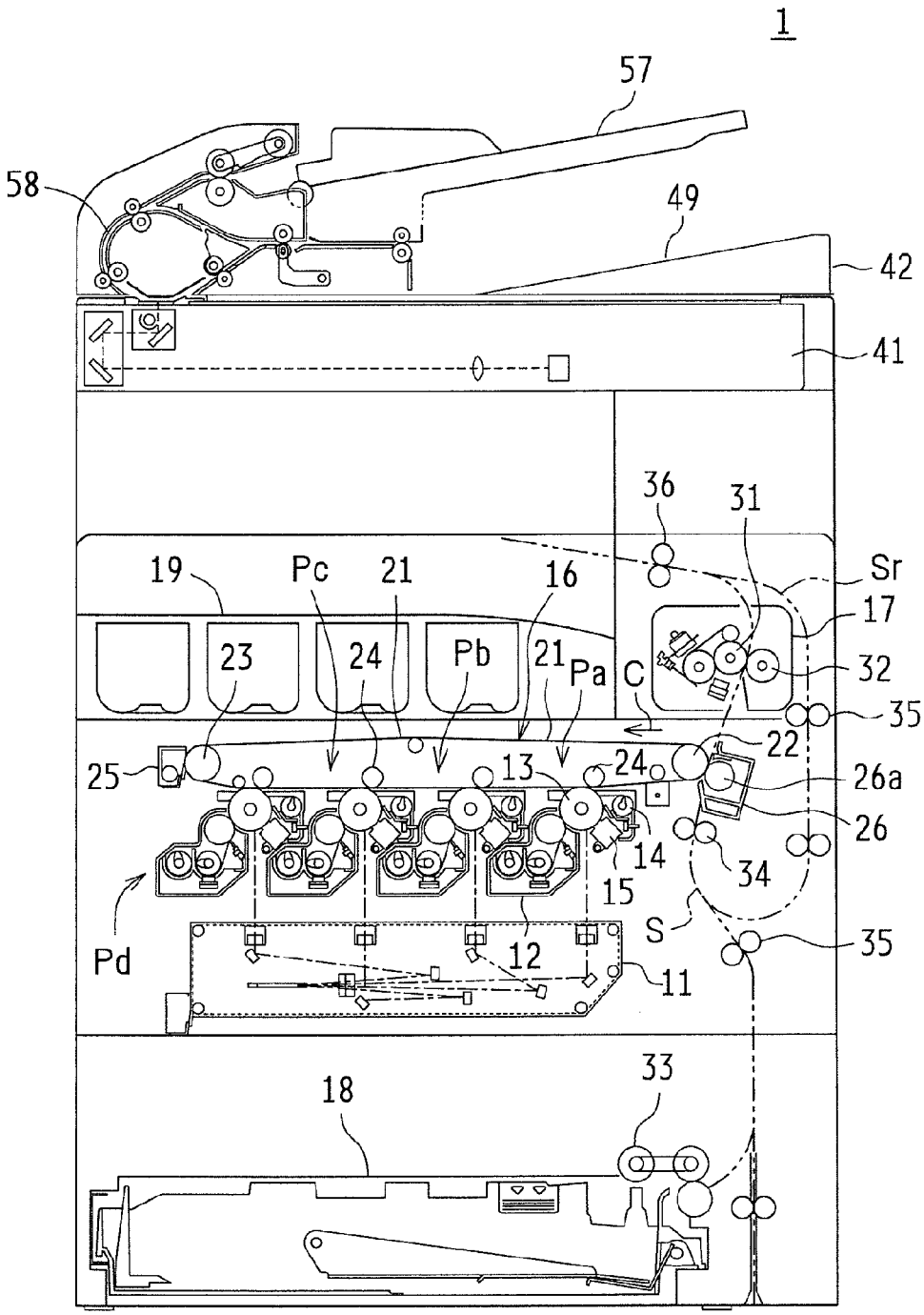
FIG. 1 is a cross-sectional view of an image forming apparatus using a reversing original transport apparatus of an embodiment of the present invention.

FIG. 1 is a cross-sectional view of an image forming apparatus using a reversing original transport apparatus of an embodiment of the present invention. The image forming apparatus 1, which is a "multifunction machine" having a scanning function, a copying function, a printing function, a facsimile function, etc., transmits an image of an original read by an image reading apparatus 41 to outside, and records such a read image of the original or an image received from outside on a recording sheet of paper in colors or in monochrome.

The image forming apparatus 1 includes a light scanning apparatus 11, development apparatuses 12, photosensitive drums 13, drum cleaning apparatuses 14, charging units 15, an intermediate transfer belt apparatus 16, a fixing apparatus 17, a sheet transport path S, a sheet feed tray 18, a sheet discharge tray 19, etc., for printing an image on a recording sheet.

Image data handled in the image forming apparatus 1 is one corresponding to a color image using black (K), cyan (C), magenta (M), and yellow (Y) or one corresponding to a monochrome image using a single color (e.g., black). Therefore, each four development apparatuses 12, photosensitive drums 13, drum cleaning apparatuses 14, and fixing units 15 are provided to form four kinds of toner images corresponding to the four colors, constituting four image stations Pa, Pb, Pc, and Pd respectively associated with black, cyan, magenta, and yellow.

Each of the photosensitive drums 13 has a photosensitive layer on its surface. Each of the charging units 15 is a charging means for charging the surface of the photosensitive drum 13 at a predetermined potential uniformly. Not only roller-type and brush-type charging units as contact-types, but also charger-type charging units may be used.

The light scanning apparatus 11, which is a laser scanning unit (LSU) provided with a laser diode and a reflection mirror, exposes the charged surfaces of the photosensitive drums 13 to light according to the image data, to form electrostatic latent images corresponding to the image data on the surfaces.

Each of the development apparatuses 12 develops the electrostatic latent image on the surface of the photosensitive drum 13 with the toner of the corresponding color, to form a toner image of the color on the surface of the photosensitive drum 13. Each of the drum cleaning apparatuses 14 removes and collects residual toner on the surface of the photosensitive drum 13 after the development and image transfer.

The intermediate transfer belt apparatus 16, placed above the photosensitive drums 13, includes an intermediate transfer belt 21, an intermediate transfer belt drive roller 22, an idler roller 23, four intermediate transfer rollers 24, and a belt cleaning apparatus 25.

The intermediate transfer belt 21 is made of a film having a thickness of about 100 μm to 150 μm in the shape of an endless belt. The intermediate transfer belt 21 is stretched around the intermediate transfer belt drive roller 22, the idler roller 23, the intermediate transfer rollers 24, etc., which support the intermediate transfer belt 21 and allow the intermediate transfer belt 21 to move around in the direction of arrow C.

The intermediate transfer rollers 24, supported rotatably near the intermediate transfer belt 21, are pressed against the corresponding photosensitive drums 13 via the intermediate transfer belt 21.

The toner images in the corresponding colors on the surfaces of the photosensitive drums 13 are sequentially transferred to and superimposed on the intermediate transfer belt 21, to form a color toner image on the intermediate transfer belt 21. The transfer of the toner images from the photosensitive drums 13 onto the intermediate transfer belt 21 is performed by the pressing of the corresponding intermediate transfer rollers 24 that are in contact with the back surface of the intermediate transfer belt 21. The intermediate transfer rollers 24 are rollers each having a metal (e.g., stainless steel) shaft having a diameter of 8-10 mm as a base and a conductive elastic material (e.g., EPDM, urethane foam, etc.) covering the shaft. A high-voltage transfer bias (a high voltage having a polarity (+) reverse to the charging polarity (−) of the toner) is applied to the intermediate transfer rollers 24 for transfer of the toner images. The high voltage is applied to the recording sheet uniformly thanks to the conductive elastic material.

The toner images in the corresponding colors on the surfaces of the photosensitive drums 13 are thus superimposed on the intermediate transfer belt 21, to form a color toner image represented by the image data. The color toner image is transported on the intermediate transfer belt 21 and then transferred onto a recording sheet in a nip region between the intermediate transfer belt 21 and a transfer roller **26*a* of a secondary transfer apparatus 26**.

A voltage (a high voltage having a polarity (+) reverse to the charging polarity (−) of the toner) for transfer of the toner images in different colors on the intermediate transfer belt 21 onto a recording sheet is applied to the transfer roller 26*a* of the secondary transfer apparatus 26. To steadily secure the nip region between the intermediate transfer belt 21 and the transfer roller 26*a* of the secondary transfer apparatus 26, either the transfer roller 26*a* or the intermediate transfer belt drive roller 22 is formed of a rigid material (a metal, etc.), and the other is formed of a flexible material (an elastic rubber, a foamable resin, etc.) such as an elastic roller.

The toner image on the intermediate transfer belt 21 may not be completely transferred onto the recording sheet by the secondary transfer apparatus 26, but some of the toner may be left behind on the intermediate transfer belt 21. Such residual toner may cause generation of toner color mixture in the next process step. To avoid this, the residual toner is removed and collected by the belt cleaning apparatus 25. The belt cleaning apparatus 25 includes, as a cleaning member, a cleaning blade that comes into contact with the intermediate transfer belt 21 to remove the residual toner, for example. At the position of the contact of the cleaning blade with the intermediate transfer belt 21, the idler roller 23 supports the back surface of the intermediate transfer belt 21.

After the color toner image is transferred onto the recording sheet in the nip region between the intermediate transfer belt 21 and the transfer roller 26*a* of the secondary transfer apparatus 26, the recording sheet is transported to the fixing apparatus 17. The fixing apparatus 17, which includes a heat roller 31, a pressure roller 32, etc., transports the recording sheet while nipping the recording sheet between the heat roller 31 and the pressure roller 32.

The heat roller 31 is controlled to maintain a predetermined fixing temperature based on a detection output of a temperature detector not shown, and subjects the recording sheet to thermocompression bonding together with the pressure roller 32, so that the color toner image transferred onto the recording sheet can be melted, mixed, and pressed, to be thermally fixed to the recording sheet.

The sheet feed tray 18, on which recording sheets are stored, is placed in the lower portion of the image forming apparatus 1 to feed a recording sheet on the tray.

The S-shaped sheet transport path S is provided in the image forming apparatus 1 for sending a recording sheet fed from the sheet feed tray 18 to the sheet discharge tray 19 via the secondary transfer apparatus 26 and the fixing apparatus 17. Along the sheet transport path S, placed are a pair of sheet registration rollers 34, the fixing apparatus 17, a plurality of pairs of transport rollers 35, a pair of sheet discharge rollers 36, etc.

A sheet pickup roller 33 is placed in an end portion of the sheet feed tray 18. By the sheet pickup roller 33, recording sheets are picked up from the sheet feed tray 18 one by one and transported to the sheet transport path S.

The transport rollers 35 are small-size rollers for facilitating and assisting the transport of the recording sheet, and placed at a plurality of positions.

The sheet registration rollers 34 bring the transported recording sheet to a temporary stop to align the top edge of the recording sheet, and then transport the recording sheet at good timing in synchronization with the rotation of the photosensitive drums 13 and the intermediate transfer belt 21 so that the color toner image on the intermediate transfer belt 21 can be transferred onto the recording sheet in the nip region between the intermediate transfer belt 21 and the transfer roller 26*a* of the secondary transfer apparatus 26.

The recording sheet is then sent to the fixing apparatus 17 where the color toner image is fixed, and after passing through the fixing apparatus 17, discharged onto the sheet discharge tray 19 face-down by the sheet discharge rollers 36.

In the case of printing on the back side of the recording sheet in addition to the front side, the sheet discharge rollers 36 are stopped midway through the transport of the recording sheet by the sheet discharge rollers 36 on the sheet transport path S, and then rotated reversely to allow the recording sheet to pass through a reverse path Sr, to be guided to the sheet registration rollers 34 with the side of the recording sheet being reversed. An image is then recorded on the back side of the recording sheet and fixed, as was done on the front side thereof, and the resultant recording sheet is discharged to the sheet discharge tray 19.

Figure 2:
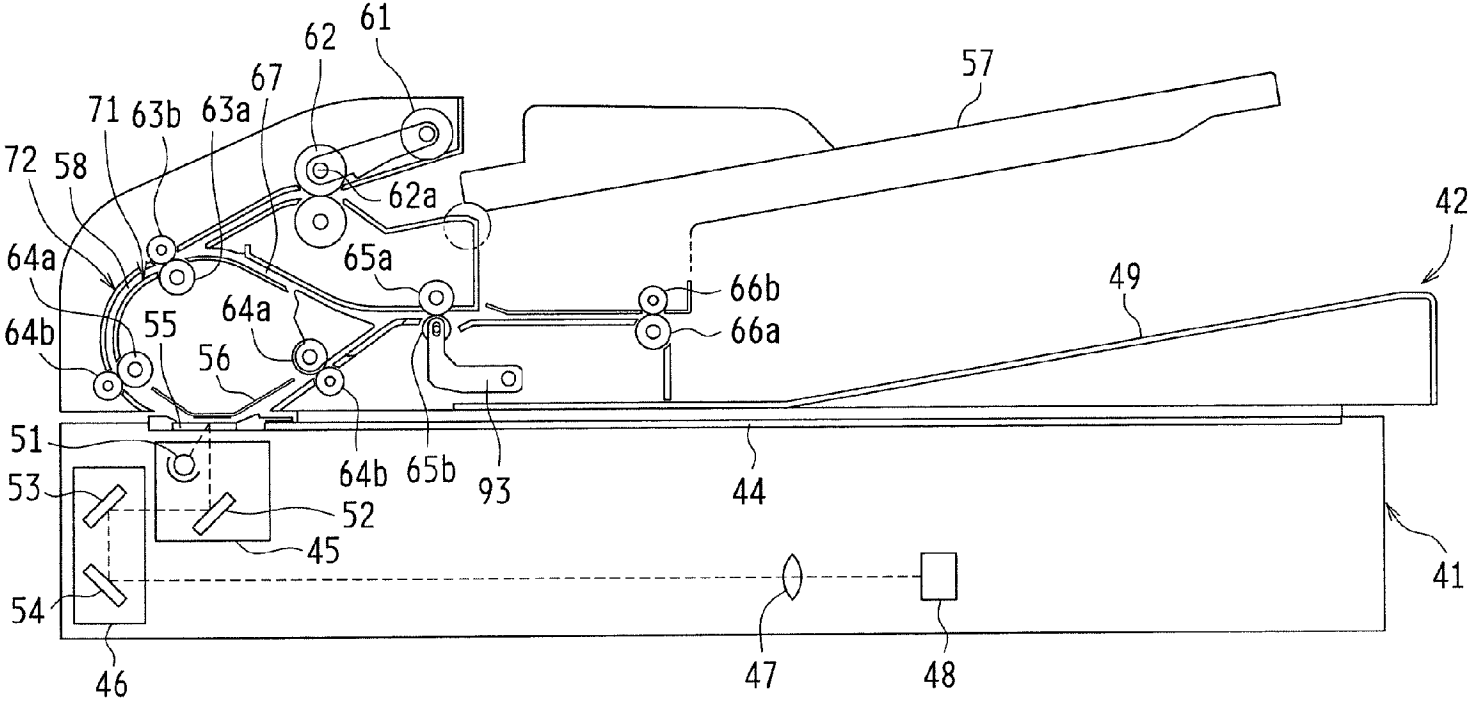
FIG. 2 is an enlarged cross-sectional view of an image reading apparatus and the reversing original transport apparatus of the image forming apparatus of FIG. 1.

Next, the image reading apparatus 41 and a reversing original transport apparatus 42 mounted in the upper portion of the image forming apparatus 1 will be described. FIG. 2 is an enlarged cross-sectional view of the image reading apparatus 41 and the reversing original transport apparatus 42.

The reversing original transport apparatus 42 is supported along its rear side by the rear side of the image reading apparatus 41 with a hinge (not shown), and is opened/closed by moving upward/downward the front-side portion of the reversing original transport apparatus 42. When the reversing original transport apparatus 42 is opened, a glass platen 44 of the image reading apparatus 41 is exposed, to allow an original to be placed on the glass platen 44.

The image reading apparatus 41 includes the glass platen 44, a first scanning unit 45, a second scanning unit 46, an imaging lens 47, a charge coupled device (CCD) 48, etc.

The first scanning unit 45 includes a light source 51 and a first reflecting mirror 52. While moving in a sub-scanning direction at a constant speed V by a distance corresponding to the size of the original, the first scanning unit 45 exposes the original on the glass platen 44 to light from the light source 51 and reflects the reflected light from the original with the first reflecting mirror 52 to guide the light into the second scanning unit 46, thereby scanning the image on the front side of the original in the sub-scanning direction. The second scanning unit 46 includes second and third reflecting mirrors 53 and 54. While moving following the first scanning unit 45 at a speed V/2, the second scanning unit 46 reflects the reflected light from the original with the second and third reflecting mirrors 53 and 54 to guide the light to the imaging lens 47. The imaging lens 47 collects the reflected light from the original onto the CCD 48, to allow the image on the front side of the original to be imaged on the CCD 48. The CCD 48 scans the image of the original in a main scanning direction repeatedly and outputs an analog image signal of one main scanning line every scanning of one main scanning line.

The image reading apparatus 41 can read, not only a still original, but also an image on an original being transported by the reversing original transport apparatus 42. In this case, the first scanning unit 45 is moved to a position under an original reading glass 55, and the second scanning unit 46 is positioned with respect to the position of the first scanning unit 45. In this state, transport of the original by the reversing original transport apparatus 42 is started.

In the reversing original transport apparatus 42, a pickup roller 61 is pressed against the original on an original tray 57 and rotated to pick up the original. The original is then sent to an original transport path 58 by a sheet feed roller 62. The top end of the original is hit against registration rollers 63*a* and 63*b* that are in a temporary stop and aligned, and then transport of the original by the registration rollers 63*a* and 63*b* is started. The original is then transported by transport rollers

64*a* and 64*b* to pass between the original reading glass 55 and a reading guide plate 56, and then transported through reverse rollers 65*a* and 65*b* and sheet discharge rollers 66*a* and 66*b* to be discharged to a discharge tray 49.

During the transport of the original described above, the front side of the original is illuminated with the light from the light source 51 of the first scanning unit 45 via the original reading glass 55. The reflected light from the front side of the original is guided to the imaging lens 47 via the reflecting mirrors of the first and second scanning units 45 and 46. The imaging lens 47 collects the reflected light from the original onto the CCD 48, to allow the image on the front side of the original to be imaged on the CCD 48. In this way, the image on the front side of the original is read.

In the case of reading the back side of the original, the reverse rollers 65*a* and 65*b* and the sheet discharge rollers 66*a* and 66*b* are stopped midway through discharge of the original to the sheet discharge tray 49 via the reverse rollers 65*a* and 65*b* and the sheet discharge rollers 66*a* and 66*b*, and subsequently rotated reversely to allow the original to pass through a reverse transport path 67, to be guided to the registration rollers 63*a* and 63*b* with the side of the original being reversed. An image on the back side of the original is then read, as was done for the image on the front side thereof. The reverse rollers 65*a* and 65*b* and the sheet discharge rollers 66*a* and 66*b* are then rotated in the forward direction to transport the original to the reverse rollers 65*a* and 65*b* and the sheet discharge rollers 66*a* and 66*b*. In order to match the order of originals and whether to place originals face up or down on the discharge tray 49 with those on the original tray 57, the reverse rollers 65*a* and 65*b* and the sheet discharge rollers 66*a* and 66*b* are rotated reversely again, to guide the original to the registration rollers 63*a* and 63*b* through the reverse transport path 67 again. The original is not read this time, and the reverse rollers 65*a* and 65*b* and the sheet discharge rollers 66*a* and 66*b* are rotated in the forward direction to discharge the original to the sheet discharge tray 49.

The image of the original read by the CCD 48 in the manner described above is output from the CCD 48 as an analog image signal, which is then converted to a digital image signal (image data). The image data is subjected to various types of image processing and then sent to the light scanning apparatus 11 of the image forming apparatus 1, where the image is recorded on a recording sheet, and the recording sheet is output as a copy of the original.

Figure 3:
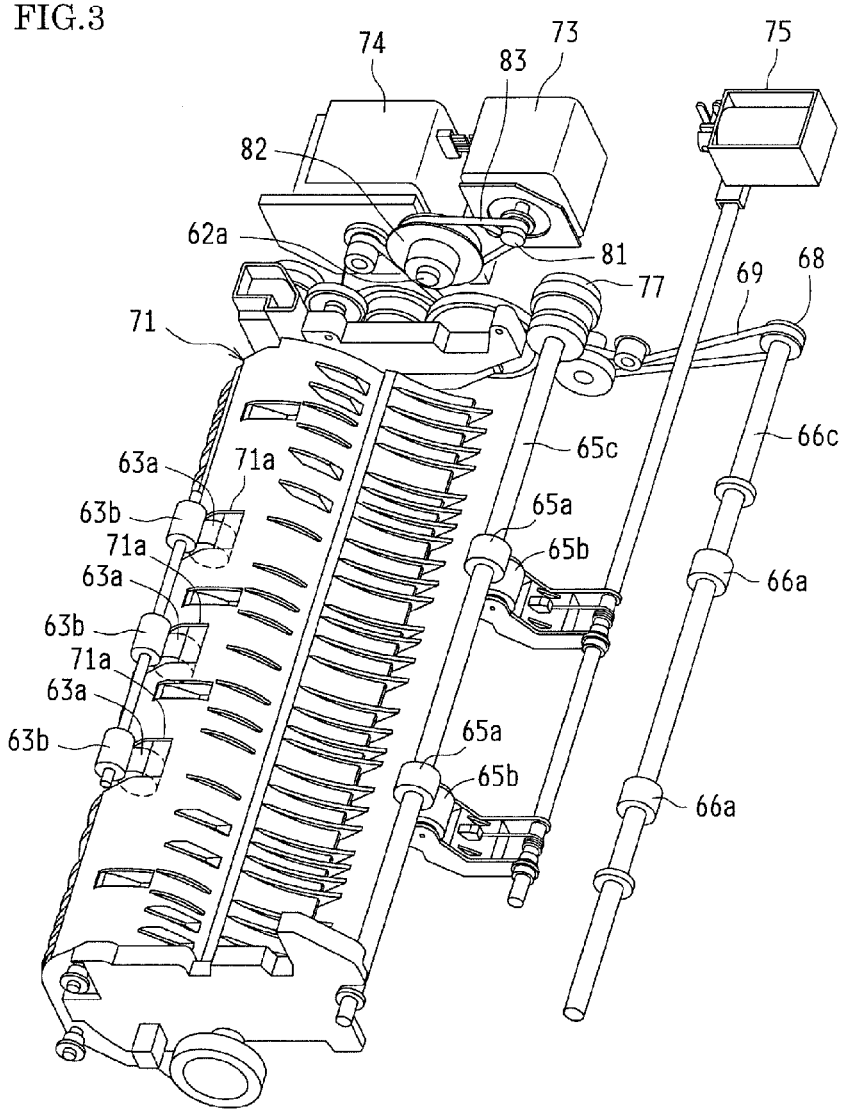
FIG. 3 is a perspective view showing an internal structure of the reversing original transport apparatus as viewed obliquely from above.

Next, the internal structure of the reversing original transport apparatus 42 will be described in more detail. FIG. 3 is a perspective view of the internal structure of the reversing original transport apparatus 42 as viewed obliquely from above, and FIG. 4 is a plan view of the internal structure of the reversing original transport apparatus 42 as viewed from above.

Figure 4:
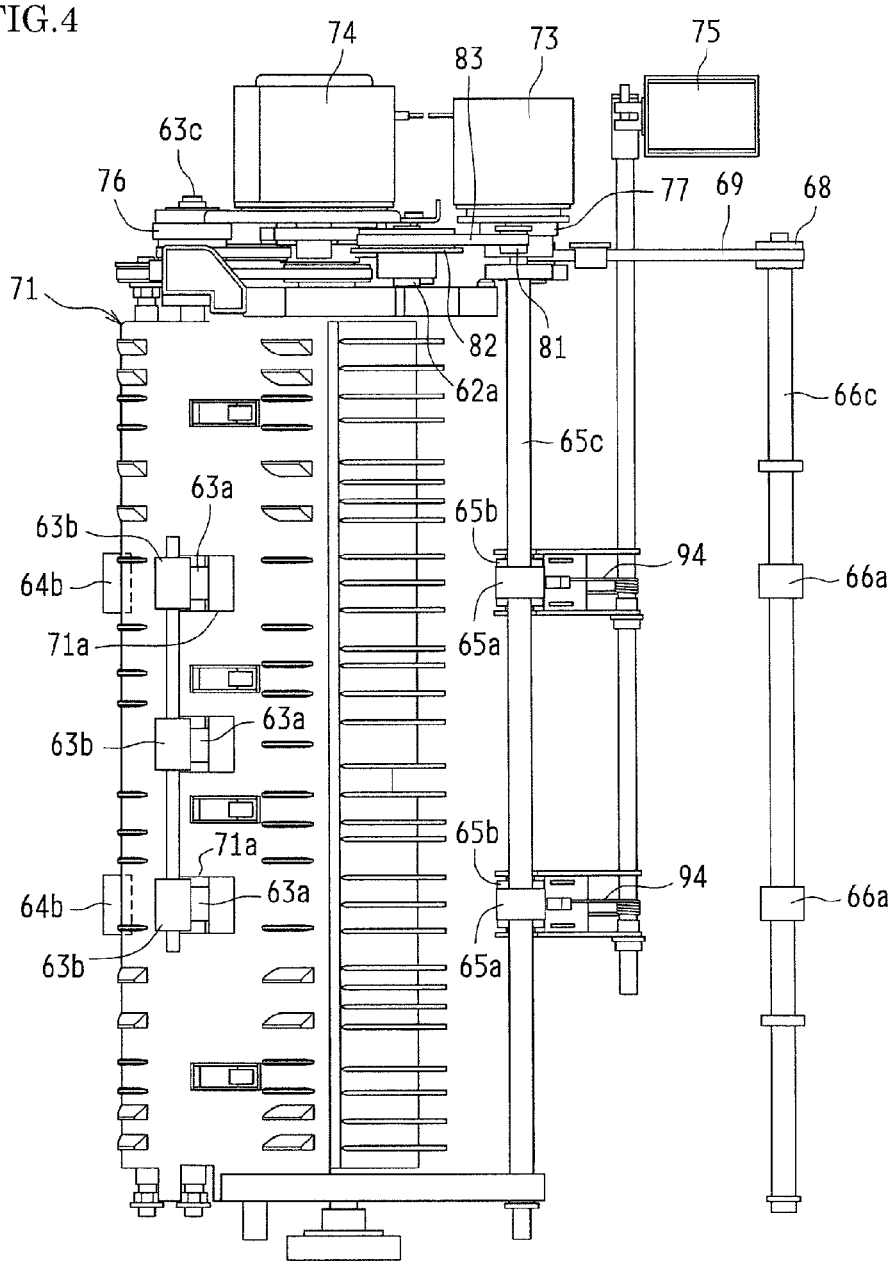
FIG. 4 is a plan view of the internal structure of the reversing original transport apparatus as viewed from above.

In FIGS. 3 and 4, an inner-circumference guide 71 forms the inner circumference of the original transport path 58 (shown in FIG. 2) and the inner circumference of the reverse transport path 67 (shown in FIG. 2). An outer-circumference guide 72 (shown in FIG. 2) is placed outside the inner-circumference guide 71, to form the original transport path 58 and the reverse transport path 67 between the inner- and outer-circumference guides 71 and 72.

The driving-side registration rollers 63*a* are placed inside the inner-circumference guide 71, and portions of the driving-side registration rollers 63*a* protrude from openings 71*a* of the inner-circumference guide 71. The idler-side registration rollers 63*b* are placed inside the outer-circumference guide 72, and are pressed against the driving-side registration rollers 63*a* via the corresponding openings 71*a*.

Similarly, the two driving-side transport rollers 64*a* (shown in FIG. 2) are placed inside the inner-circumference guide 71, and portions of the two driving-side transport rollers 64*a* protrude from openings of the inner-circumference guide 71. The two idler-side transport rollers 64*b* (shown in FIG. 2) are placed inside the outer-circumference guide 72, and are pressed against the driving-side transport rollers 64*a* via the corresponding openings.

The reverse rollers 65*a* and 65*b* are placed at positions downstream of the inner-circumference guide 71 in the original transport direction, and the sheet discharge rollers 66*a* and 66*b* (shown in FIG. 2) are placed at positions further downstream.

A driving system of the reversing original transport apparatus 42 is placed on one side of the inner-circumference guide 71. The driving system includes a sheet feed motor 73, a transport motor 74, a solenoid 75, a registration roller electromagnetic clutch 76, a reverse roller electromagnetic clutch 77, etc.

The sheet feed motor 73 rotationally drives the pickup roller 61 and the sheet feed roller 62 (shown in FIG. 2). A pulley 81 is secured to the output shaft of the sheet feed motor 73, a pulley 82 is secured to a shaft 62*a* of the sheet feed roller 62, and an endless belt 83 is stretched between the pulleys 81 and 82, to convey the rotation of the output shaft of the sheet feed motor 73 to the shaft 62*a* of the sheet feed roller 62 via the pulleys 81 and 82 and the endless belt 83, and thus rotate the sheet feed roller 62. Furthermore, the rotation of the sheet feed roller 62 is conveyed to the pickup roller 61 via a driving force conveying mechanism as a combination of pulleys and an endless belt (not shown), to rotate the pickup roller 61. The pickup roller 61 is supported to be rotationally movable around the shaft 62*a* of the sheet feed roller 62 as the center. When the sheet feed roller 62 and the pickup roller 61 are rotationally driven, a rotational moment is generated around the shaft 62*a* of the sheet feed roller 62, causing the pickup roller 61 to move rotationally around the shaft 62*a* of the sheet feed roller 62 to be pressed against the original on the original tray 57, whereby the original is picked up by the pickup roller 61.

The transport motor 74 rotationally drives the registration rollers 63*a* and 63*b*, the transport rollers 64*a* and 64*b*, the reverse rollers 65*a* and 65*b*, and the sheet discharge rollers 66*a* and 66*b*. The rotational driving force of the output shaft of the transport motor 74 is conveyed to a shaft 63*c* of the driving-side registration rollers 63*a*, the shaft (not shown) of the driving-side transport rollers 64*a*, and a shaft 65*c* of the driving-side reverse rollers 65*a* via a driving force conveying mechanism as a combination of a plurality of pulleys (some of them not shown) and a plurality of endless belts (some of them not shown), to rotate the driving-side rollers 63*a*, 64*a*, and 65*a*. The registration rollers 63*a* and 63*b* are pressed against each other at any time. Therefore, once the driving-side registration roller 63*a* is rotationally driven, the idler-side registration roller 63*b* follows the rotation of the roller 63*a*. Similarly, the transport rollers 64*a* and 64*b* are pressed against each other at any time. Therefore, once the driving-side transport roller 64*a* is rotationally driven, the idler-side transport roller 64*b* follows the rotation of the roller 64*a*. Furthermore, the reverse rollers 65*a* and 65*b* are pressed against each other, or separate from each other, with the movement of the idler-side reverse roller 65*b*, and once the driving-side reverse roller 65*a* is rotationally driven when the paired rollers are pressed against each other, the idler-side reverse roller 65*b* follows the rotation of the roller 65*a*. The idler-side reverse roller 65*b* is moved by the solenoid 75.

Moreover, the rotation of the shaft 63*c* of the driving-side reverse rollers 65*a* is conveyed to a shaft 66*c* of the driving-side sheet discharge rollers 66*a* via a rotation conveying section as a combination of a pulley 68, and an endless belt 69, etc., to rotate the driving-side sheet discharge rollers 66*a*. The sheet discharge rollers 66*a* and 66*b* are pressed against each other at any time. Therefore, once the driving-side sheet discharge roller 66*a* is rotationally driven, the idler-side sheet discharge roller 66*b* follows the rotation of the roller 66*a*.

The registration roller electromagnetic clutch 76 is placed at one end of the shaft 63*c* of the driving-side registration rollers 63*a*, to permit or block conveyance of the rotation of the output shaft of the transport motor 74 to the shaft 63*c*, thereby allowing or stopping the rotation of the driving-side registration rollers 63*a*. Similarly, the reverse roller electromagnetic clutch 77 is placed at one end of the shaft 65*c* of the driving-side reverse rollers 65*a*, to permit or block conveyance of the rotation of the output shaft of the transport motor 74 to the shaft 65*c*, thereby allowing or stopping the rotation of the driving-side reverse rollers 65*a*.

Figure 5:
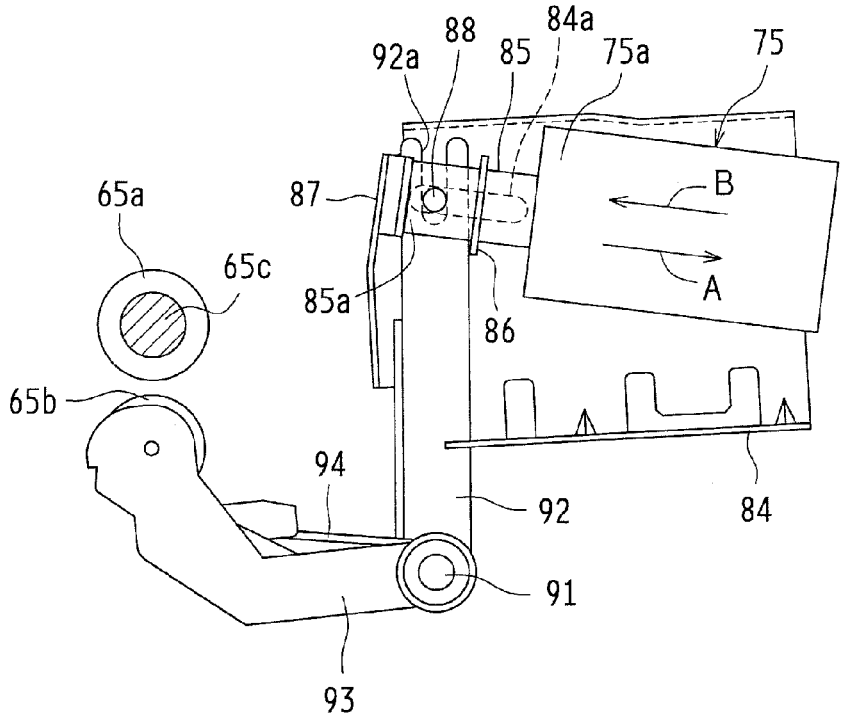
FIG. 5 is a side view of a mechanism for bringing reverse rollers into contact with each other or separating them from each other in the reversing original transport apparatus.
Figure 6:
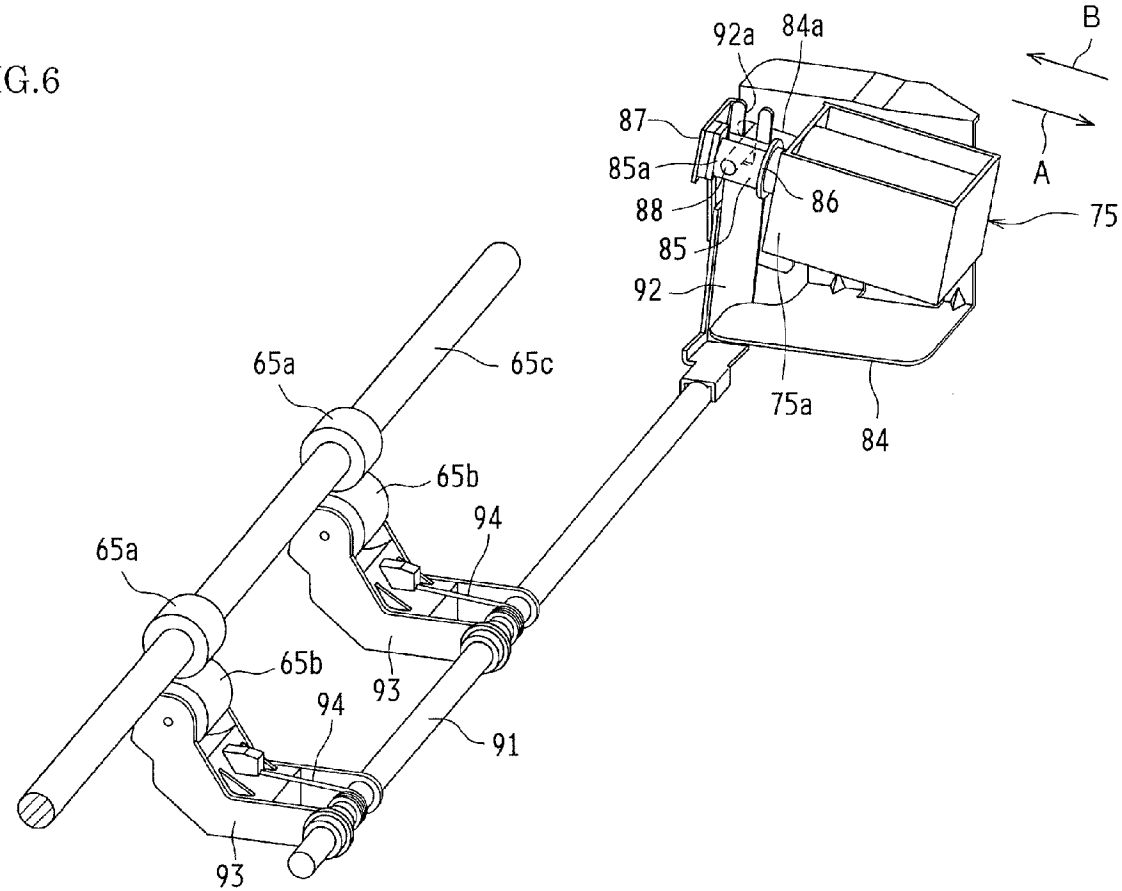
FIG. 6 is a perspective view of the above mechanism in the reversing original transport apparatus.

FIG. 5 is a side view showing a mechanism for bringing the idler-side reverse roller 65*b* into contact with, or separating it from, the driving-side reverse roller 65*a*, and FIG. 6 is a perspective view of this mechanism as viewed obliquely from above.

In FIGS. 5 and 6, the solenoid 75 is attached to a frame 84 that is secured to the inside of the reversing original transport apparatus 42. The solenoid 75 has a plunger 85 that is moved in the direction of arrow A to be attracted to the inside of a body 75*a* of the solenoid 75 and moved in the direction of arrow B to protrude from the body 75*a*. A stopper 87 is placed to the frame 84 to face a tip 85*a* of the plunger 85. When the plunger 85 protrudes, the tip 85*a* thereof abuts against the stopper 87, thereby setting the protruding position of the plunger 85. Also, an E ring 86 is secured to the plunger 85. When the plunger 85 is attracted to the inside, the E ring 86 abuts against the body 75*a*, thereby setting the attracted position of the plunger 85.

A pin 88 is secured to the plunger 85 extending through a tip portion of the plunger 85, and one end of the pin 88 is inserted into a guide hole 84*a* of the frame 84. The guide hole 84*a* of the frame 84 is long in the direction of movement of the plunger 85, to guide the pin 88 moving together with the plunger 85 prohibiting rotation of the plunger 85.

The pin 88 is also inserted into an elongate hole 92*a* of a lever 92 secured to one end of a rotary shaft 91. The elongate hole 92*a* of the lever 92 extends in the direction orthogonal to the direction of movement of the plunger 85 of the solenoid 75. When the pin 88 moves together with the plunger 85, the sides of the elongate hole 92*a* of the lever 92 are pressed by the pin 88, causing the lever 92 to revolve around the rotary shaft 91 and then the rotary shaft 91 to rotate.

The rotary shaft 91 is rotatably supported to the inside of the reversing original transport apparatus 42, and L-shaped arms 93 are rotatably supported to the rotary shaft 91 at two positions. A torsion coil spring 94 is locked at its ends to each of the L-shaped arms 93 and the rotary shaft 91, so that the biasing force of the torsion coil spring 94 acts on the L-shaped arm 93 in the circumferential direction of the rotary shaft 91. The idler-side reverse roller 65*b* is rotatably supported at the tip of each L-shaped arm 93.

The pin 88, the lever 92, the rotary shaft 91, and the L-shaped arms 93 described above constitute a link mechanism that conveys the movement of the plunger 85 of the solenoid 75 to the idler-side reverse rollers 65*b*, causing the idler-side reverse rollers 65*b* to move rotationally around the rotary shaft 91, thereby performing switching between the state where the reverse rollers 65*a* and 65*b* are pressed against each other and the state where the reverse rollers 65*a* and 65*b* are apart from each other.

Figure 7:
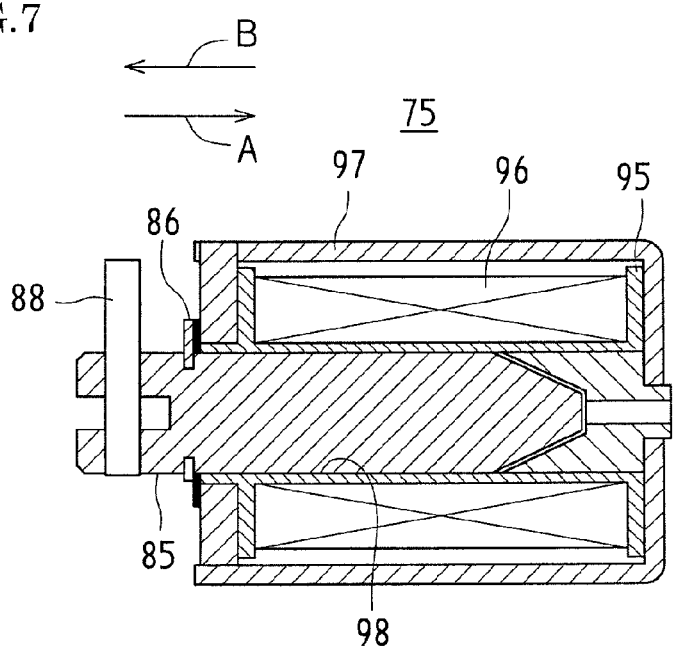
FIG. 7 is a cross-sectional view showing a configuration of a solenoid of the reversing original transport apparatus.

FIG. 7 is a cross-sectional view showing a configuration of the solenoid 75. As shown in FIG. 7, the solenoid 75 includes the plunger 85, a bobbin 95, a coil 96 wound around the bobbin 95, and a yoke 97 covering the bobbin 95 and the coil 96. The plunger 85 is movably inserted into a hollow hole 98 formed in the center of the bobbin 95, the coil 96, and the yoke 97.

Figure 8:
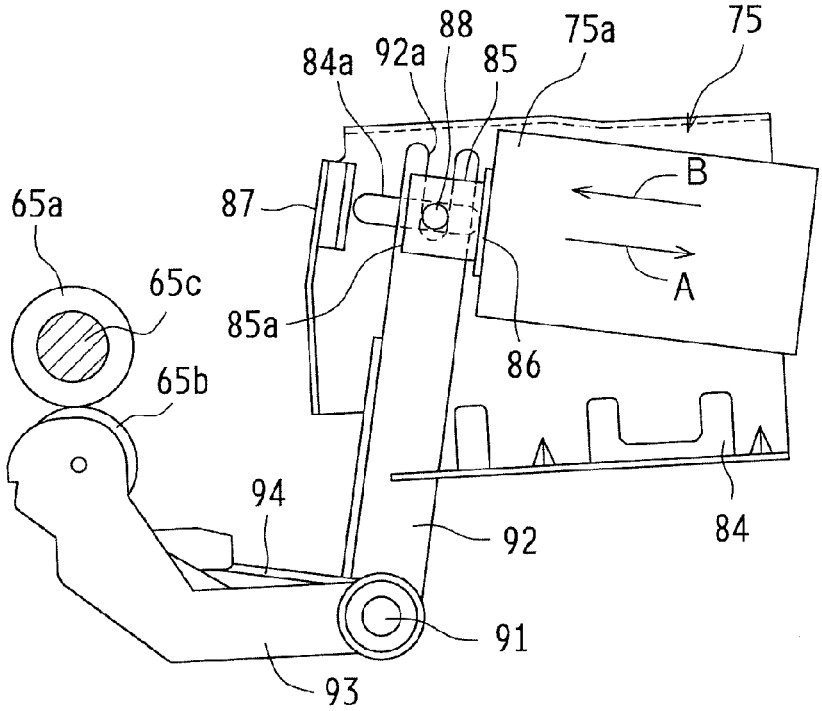
FIG. 8 is a side view showing the state of the reverse rollers in contact with each other in the reversing original transport apparatus.

When a current is allowed to flow to the coil 96 to energize the coil 96, the plunger 85 moves in the direction of arrow A into the hollow hole 98 under attraction by the magnetic force of the coil 96. At this time, as shown in FIG. 8, the lever 92 revolves around the rotary shaft 91 clockwise, and the rotary shaft 91 and each L-shaped arm 93 also revolve clockwise, causing the idler-side reverse roller 65*b* at the tip of the L-shaped arm 93 to move upward and come into contact with the driving-side reverse roller 65*a*. After the contact of the idler-side reverse roller 65*b* with the driving-side reverse roller 65*a*, the rotary shaft 91 further rotates clockwise against the biasing force of the torsion coil spring 94 with respect to the L-shaped arm 93, generating the biasing force in the torsion coil spring 94. With the biasing force in the torsion coil spring 94, the idler-side reverse roller 65*b* at the tip of the L-shaped arm 93 is biased clockwise to be pressed against the driving-side reverse roller 65*a*. In this state, when the driving-side reverse roller 65*a* is rotationally driven, the idler-side reverse roller 65*b* follows the rotation.

When the coil 96 is de-energized, the plunger 85 is left freely movable. The idler-side reverse roller 65*b* at the tip of the L-shaped arm 93 has been biased clockwise around the rotary shaft 91 due to the biasing force of the torsion coil spring 94 as shown in FIG. 8 during the energization of the coil 96. Therefore, once the coil 96 is de-energized, the idler-side reverse roller 65*b* revolves counterclockwise leaving the driving-side reverse roller 65*a* as shown in FIGS. 5 and 6. The L-shaped arm 93 further revolves counterclockwise around the rotary shaft 91 due to its own weight, separating the idler-side reverse roller 65*b* from the driving-side reverse roller 65*a*. Along with this movement, the rotary shaft 91 and the lever 92 also revolve counterclockwise, causing the plunger 85 to move in the direction of arrow B protruding from the hollow hole 98.

Thus, when the coil 96 of the solenoid 75 is energized, the plunger 85 is attracted in the direction of arrow A by the magnetic force of the coil 96, causing the lever 92, the rotary shaft 91, and the L-shaped arms 93 to revolve clockwise, to bring the idler-side reverse rollers 65*b* into contact with the driving-side reverse rollers 65*a*. The biasing force is then generated in the torsion coil springs 94, and with this biasing force, the idler-side reverse rollers 65*b* are pressed against the driving-side reverse rollers 65*a*. When the coil 96 is de-energized, the idler-side reverse rollers 65*b* move rotationally counterclockwise, leaving the driving-side reverse rollers 65*a*, due to the biasing force of the torsion coil springs 94. The idler-side reverse rollers 65*b* is thus separated from the driving-side reverse rollers 65*a*. The rotary shaft 91 and the lever 92 also revolve counterclockwise, allowing the plunger 85 to protrude in the direction of arrow B.

Next, referring to FIG. 9 that is a side view of the reversing original transport apparatus 42, the outlines of the original transport operation and the operation of reversing the side of the original by the reversing original transport apparatus 42 will be described.

First, the sheet feed motor 73 is rotated, to pick up an original on the original tray 57 and send the original to the original transport path 58 by the sheet feed roller 62 and the pickup roller 61. At this time, while the transport motor 74 is normally rotated, the registration roller electromagnetic clutch 76 is disengaged, to stop the registration rollers 63*a* and 63*b* temporarily, so that the top edge of the original is hit against the registration rollers 63*a* and 63*b* and aligned.

The registration roller electromagnetic clutch 76 is then engaged, to rotate the registration rollers 63*a* and 63*b* and thus start transport of the original. The original is further transported by the transport rollers 64*a* and 64*b* and passes between the original reading glass 55 and the reading guide plate 56. Immediately before the bottom edge of the original passes through the transport rollers 64*a* and 64*b* located downstream of the original reading glass 55 and the reading guide plate 56 in the original transport direction, the coil 96 of the solenoid 75 is energized, so that the idler-side reverse rollers 65*b* are pressed against the driving-side reverse rollers 65*a*, and the reverse roller electromagnetic clutch 77 is engaged, to rotate the reverse rollers 65*a* and 65*b* and the sheet discharge rollers 66*a* and 66*b*. The original is thus transported through the reverse rollers 65*a* and 65*b* and the sheet discharge rollers 66*a* and 66*b* to be discharged to the sheet discharge tray 49.

In the case of reversing the side of the original to read an image on the back side of the original, the transport motor 74 is stopped midway through the discharge of the original W to the sheet discharge tray 49 via the reverse rollers 65*a* and 65*b* and the sheet discharge rollers 66*a* and 66*b*, to stop the reverse rollers 65*a* and 65*b* and the sheet discharge rollers 66*a* and 66*b*. Subsequently, the transport motor 74 is rotated reversely to rotate the reverse rollers 65*a* and 65*b* and the sheet discharge rollers 66*a* and 66*b* reversely, so that the original W is transported back to the registration rollers 63*a* and 63*b* through the reverse transport path 67. At this time, the registration roller electromagnetic clutch 76 is disengaged, to stop the registration rollers 63*a* and 63*b* temporarily, so that the bottom edge of the original W is hit against the registration rollers 63*a* and 63*b* and aligned.

The transport motor 74 is stopped again and then rotated normally. In the period between the stop and the resumed normal rotation of the transport motor 74, the registration roller electromagnetic clutch 76 is engaged to permit rotational drive of the registration rollers 63*a* and 63*b*. Also, subsequent to the resumed normal rotation of the transport motor 74, the reverse roller electromagnetic clutch 77 is disengaged, to render the reverse rollers 65*a* and 65*b* and the sheet discharge rollers 66*a* and 66*b* freely rotatable. Further, the coil 96 of the solenoid 75 is de-energized, to separate the idler-side reverse rollers 65*b* from the driving-side reverse rollers 65*a*. In this state, while the registration rollers 63*a* and 63*b* are rotationally driven to start transport of the original W, the sheet discharge rollers 66*a* and 66*b* are allowed to drag the original W and the reverse rollers 65*a* and 65*b* are separated from each other, permitting the original W to be pulled out reversely from the reverse rollers 65*a* and 65*b* and the sheet discharge rollers 66*a* and 66*b*, facilitating the transport of the original W.

The subsequent process is similar to that described above. That is, the original W is transported by the transport rollers 64*a* and 64*b* and passes between the original reading glass 55 and the reading guide plate 56. The coil 96 of the solenoid 75 is energized, so that the idler-side reverse rollers 65*b* are pressed against the driving-side reverse rollers 65*a*, and the reverse roller electromagnetic clutch 77 is engaged, to rotate the reverse rollers 65*a* and 65*b* and the sheet discharge rollers 66*a* and 66*b* in the forward direction. The original W is thus transported through the reverse rollers 65*a* and 65*b* and the sheet discharge rollers 66*a* and 66*b* to be discharged to the sheet discharge tray 49.

Figure 9:
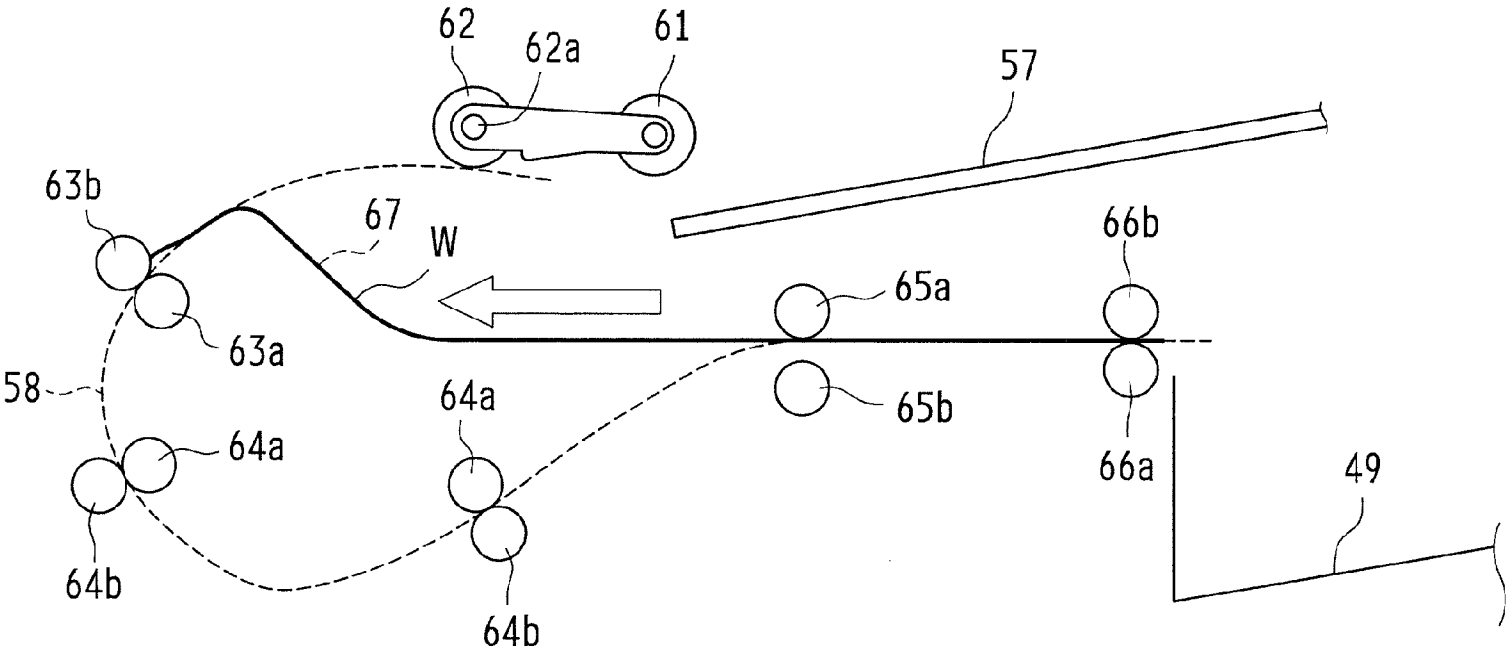
FIG. 9 is a side view schematically showing the reversing original transport apparatus.

As is apparent from FIG. 9, in the state where, in order to reverse the side of the original W, the original W is transported to the registration rollers 63*a* and 63*b* through the reverse transport path 67 by the reverse rollers 65*a* and 65*b* and the bottom edge of the original W is hit against the registration rollers 63*a* and 63*b*, the original W is pinched between the reverse rollers 65*a* and 65*b* and between the sheet discharge rollers 66*a* and 66*b*. Therefore, if the reverse roller electromagnetic clutch 77 is disengaged too early, the original W may be sent back toward the reverse rollers 65*a* and 65*b* due to the elastic force of the original W that has hit against the registration rollers 63*a* and 63*b* and bent, resulting in separation of the bottom edge of the original W from the registration rollers 63*a* and 63*b*. In this state, the original W will not be transported even though the registration rollers 63*a* and 63*b* are rotated, causing jamming.

To avoid the above problem, in the reversing original transport apparatus 42 of this embodiment, the timing of engagement of the registration roller electromagnetic clutch 76 and the timing of disengagement of the reverse roller electromagnetic clutch 77 are controlled properly, and the timing of on/off of the coil 96 of the solenoid 75 is controlled properly, in accordance with the timing of stop of the transport motor 74 and the timing of start of the resumed normal rotation, thereby preventing occurrence of such jamming.

Figure 10:
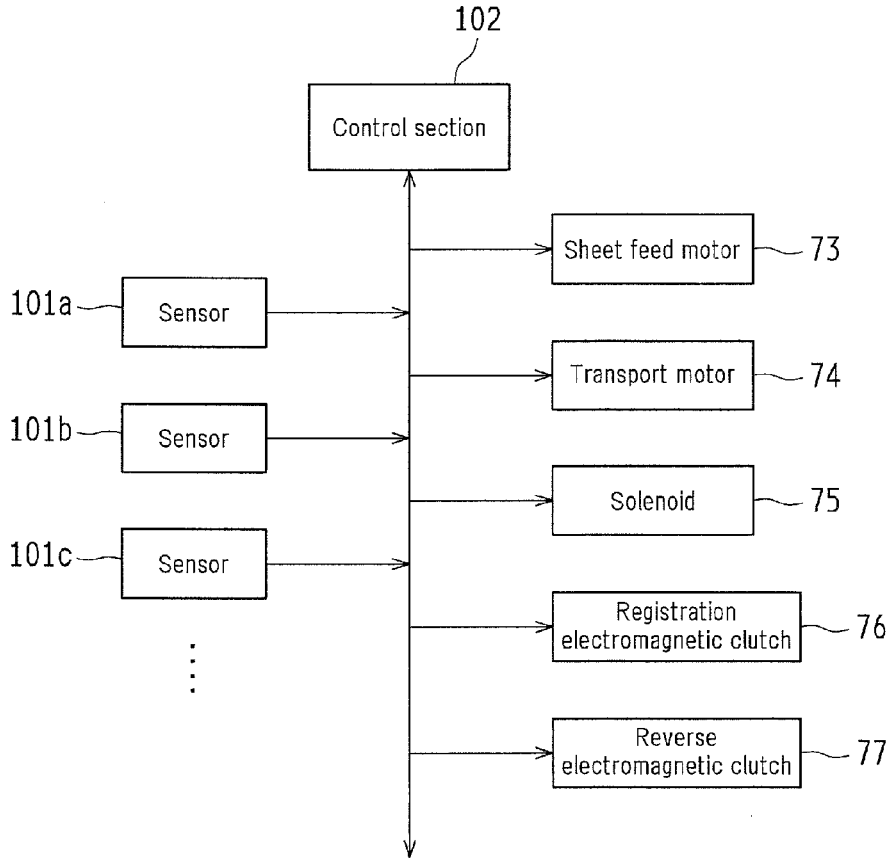
FIG. 10 is a block diagram showing a control system of the reversing original transport apparatus including a registration roller electromagnetic clutch, a reverse roller electromagnetic clutch, the solenoid, etc.

Next, the control of the transport motor 74, the solenoid 75, the registration roller electromagnetic clutch 76, the reverse roller electromagnetic clutch 77, etc. will be described. FIG. 10 is a block diagram showing the control system of the reversing original transport apparatus 42. In FIG. 10, a plurality of sensors 101*a*, 101*b*, 101*c*, . . . detect the presence/absence of an original on the original tray 57, detect the positions of the top and bottom edges of the original at a plurality of positions on the original transport path 58, and outputs the detection results to a control section 102. The control section 102 controls the driving of the sheet feed motor 73, the transport motor 74, the solenoid 75, the registration roller electromagnetic clutch 76, the reverse roller electromagnetic clutch 77, etc. based on the detection results from the sensors 101*a*, . . . , to pull out the original from the original tray 57 and transport the original.

For example, when the sensor 101*a* detects an original on the original tray 57, the control section 102 rotates the sheet feed motor 73, whereby the original is pulled out from the original tray 57 and sent to the original transport path 58 by the sheet feed roller 62 and the pickup roller 61. Also, when the sensor 101*b* placed at a position upstream of the registration rollers 63*a* and 63*b* in the original transport direction detects the top edge of the original, the control section 102 engages the registration roller electromagnetic clutch 76 at this detection timing to start transport of the original by the registration rollers 63*a* and 63*b*. Moreover, immediately before passing of the bottom edge of the original through the transport rollers 64*a* and 64*b* placed downstream of the original reading glass 55 and the reading guide plate 56 in the original transport direction, the control section 102 energizes the coil 96 of the solenoid 75, to press the idler-side reverse rollers 65*b* against the driving-side reverse rollers 65*a*, and engages the reverse roller electromagnetic clutch 77, to transport the original through the reverse rollers 65*a* and 65*b* and the sheet discharge rollers 66*a* and 66*b* to be discharged to the sheet discharge tray 49.

In the case of reversing the side of the original to read an image on the back side of the original, when the sensor 101*c* placed upstream of the reverse rollers 65*a* and 65*b* in the original transport direction detects the bottom edge of the original, the control section 102 stops the transport motor 74 and then rotates the transport motor 74 reversely, to rotate the reverse rollers 65*a* and 65*b* and the sheet discharge rollers 66*a* and 66*b* in the reverse direction, whereby the original is transported to the registration rollers 63*a* and 63*b* through the reverse transport path 67. The control section 102 then disengages the registration roller electromagnetic clutch 76, to allow the bottom edge of the original to hit against the registration rollers 63*a* and 63*b* and be aligned. Subsequently, the control section 102 rotates the transport motor 74 normally again and engages the registration roller electromagnetic clutch 76, to start transport of the original by the registration rollers 63*a* and 63*b*. Also, the control section 102 de-energizes the coil 96 of the solenoid 75 to separate the idler-side reverse rollers 65*b* from the driving-side reverse rollers 65*a*, and disengages the reverse roller electromagnetic clutch 77 to enable pulling out of the original from the reverse rollers 65*a* and 65*b* and the sheet discharge rollers 66*a* and 66*b* in the reverse direction. Further, the original is transported again by the transport rollers 64*a* and 64*b*. The control section 102 then energizes the coil 96 of the solenoid 75 to press the idler-side reverse rollers 65*b* against the driving-side reverse rollers 65*a*, and engages the reverse roller electromagnetic clutch 77 to rotate the reverse rollers 65*a* and 65*b* and the sheet discharge rollers 66*a* and 66*b* in the forward direction, whereby the original is transported and discharged to the sheet discharge tray 49.

Figure 11:
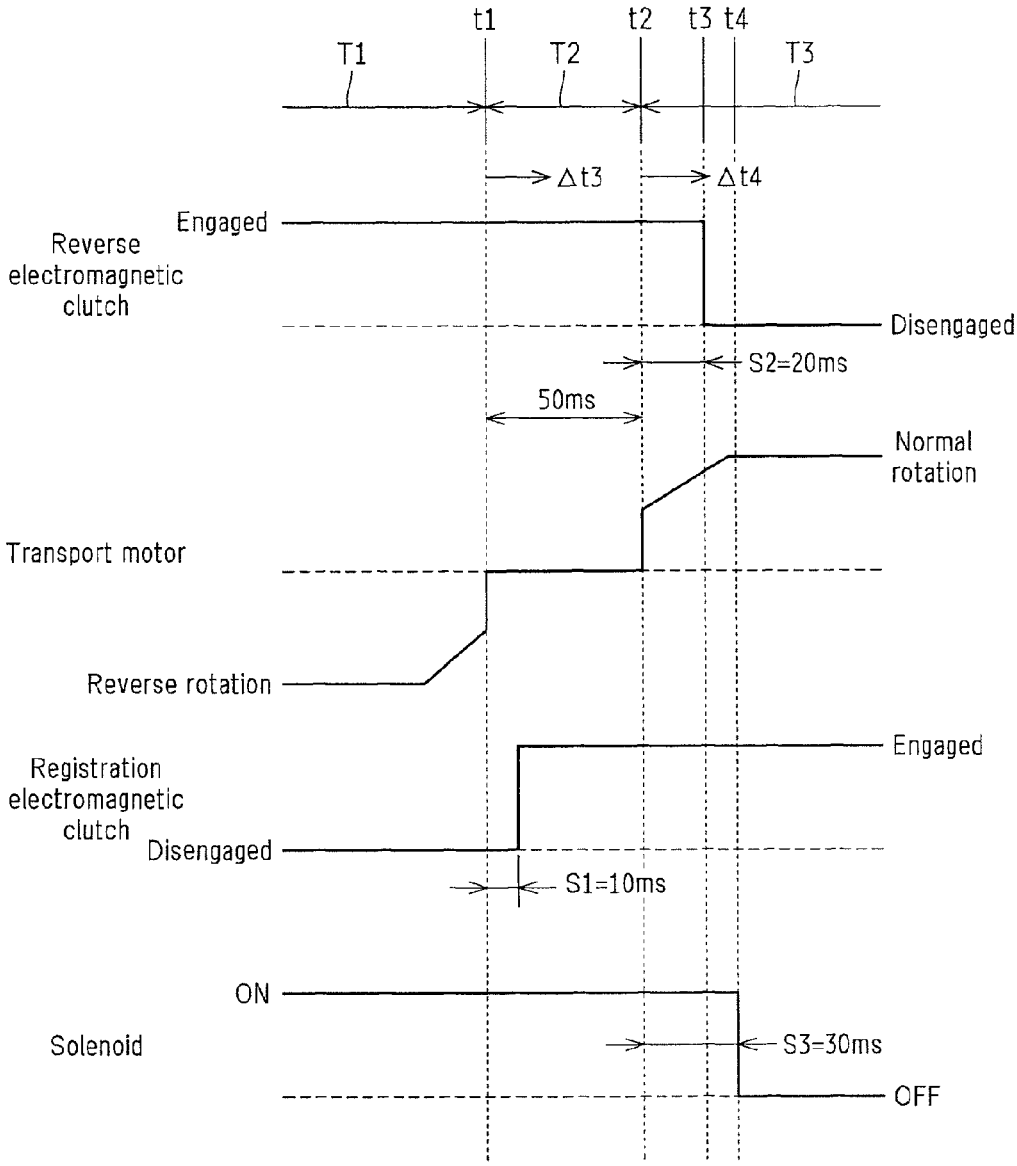
FIG. 11 is a timing chart showing engagement and disengagement of the reverse roller electromagnetic clutch, reverse rotation, stop, and forward rotation of the transport motor, engagement and disengagement of the registration roller electromagnetic clutch, and on/off of the solenoid.

Next, the control of the transport motor 74, the solenoid 75, the registration roller electromagnetic clutch 76, and the reverse roller electromagnetic clutch 77 at the time of reversing the side of the original will be described in detail. FIG. 11 is a timing chart showing the engagement and disengagement of the reverse roller electromagnetic clutch 77, the reverse rotation, stop, and normal rotation of the transport motor 74, the engagement and disengagement of the registration roller electromagnetic clutch 76, and the on/off of the coil 96 of the solenoid 75.

In FIG. 11, period T1 preceding time point t1 is a time period during which the transport motor 74 rotates reversely, period T2 between the time point t1 and time point t2 is a time period during which the transport motor 74 is at rest, and period T3 after the time point t2 is a time period during which the transport motor 74 rotates normally. Note that the original transport speed by the normal and reverse rotation of the transport motor 74 is 259.5 mm/s, for example. The period T2 during which the transport motor 74 is at rest is provided for preventing the transport motor 74 from losing synchronism. For example, the transport motor 74 is excited to bring the transport motor 74 to a complete stop during the stop period T2, to prevent phase shifting of the transport motor 74 during the subsequent period T3.

During the period T1, the coil 96 of the solenoid 75 is energized, so that the reverse rollers 65*a* and 65*b* are pressed against each other. The reverse roller electromagnetic clutch 77 is engaged, so that the reverse rollers 65*a* and 65*b* and the sheet discharge rollers 66*a* and 66*b* can be rotationally driven by the transport motor 74. Moreover, the registration roller electromagnetic clutch 76 is disengaged, so that the registration rollers 63*a* and 63*b* are at rest. In this state, the control section 102 rotates the transport motor 74 reversely, to rotate the reverse rollers 65*a* and 65*b* and the sheet discharge rollers 66*a* and 66*b* in the reverse direction, so as to transport the original W to the registration rollers 63*a* and 63*b* through the reverse transport path 67 and allow the bottom edge of the original W to abut against the registration rollers 63*a* and 63*b* that are at rest, and then stops the transport motor 74 at the time point t1.

The period T2 where the transport motor 74 is at rest is set at 50 milliseconds (ms). During the period T2, the control section 102 counts a first elapse time Δt3 from the time point t1 at which the transport motor 74 is stopped, and, when the first elapse time Δt3 reaches a first specified time S1 (=10 ms), engages the registration roller electromagnetic clutch 76, to secure the engagement of the registration roller electromagnetic clutch 76 by the start of the subsequent period T3. At this time, with the transport motor 74 being at rest, the registration rollers 63*a* and 63*b* are kept stopped.

Subsequently, at the time point t2 at which the first elapse time Δt3 reaches 50 ms, i.e., at the start of the period T3, the control section 102 starts normal rotation of the transport motor 74. Note however that, even though the normal rotation of the transport motor 74 is started, the rotation of the reverse rollers 65*a* and 65*b* and the sheet discharge rollers 66*a* and 66*b* is not started immediately, and also the rotation of the registration rollers 63*a* and 63*b* is not started immediately. The reason is that a time lag occurs from the time point t2 at which the normal rotation of the transport motor 74 is started until start of the rotation of the rollers 65*a*, 65*b*, 66*a*, 66*b*, 63*a*, and 63*b* due to backlash of pulleys, belts, gears, etc. used for conveying the rotation of the transport motor 74 to the reverse rollers 65*a* and 65*b*, the sheet discharge rollers 66*a* and 66*b*, and the registration rollers 63*a* and 63*b*. Also, a time lag occurs from the time point t2 at which the normal rotation of the transport motor 74 is started until increase of the rotational speed of the reverse rollers 65*a* and 65*b*, the sheet discharge rollers 66*a* and 66*b*, and the registration rollers 63*a* and 63*b*. In the reversing original transport apparatus 42 of this embodiment, such a time lag is approximately 20 ms.

For the reason described above, the control section 102 counts a second elapse time Δt4 from the time point t2 of start of normal rotation of the transport motor 74, and, when the second elapse time Δt4 reaches a second specified time S2 (a fixed time=20 ms), switches the reverse roller electromagnetic clutch 77 from the engaged state to the disengaged state, assuming that the registration rollers 63*a* and 63*b* would start their rotation to start transport of the original by the registration rollers 63*a* and 63*b* at this time point t3. This renders the reverse rollers 65*a* and 65*b* and the sheet discharge rollers 66*a* and 66*b* freely rotatable. When the second elapse time Δt4 reaches a third specified time S3 (=30 ms), the control section 102 de-energizes the coil 96 of the solenoid 75 to separate the idler-side reverse rollers 65*b* from the driving-side reverse rollers 65*a*.

Thus, before the start of the transport of the original by the registration rollers 63*a* and 63*b*, the reverse roller electromagnetic clutch 77 is engaged, preventing the reverse rollers 65*a* and 65*b* and the sheet discharge rollers 66*a* and 66*b* from dragging the original. Thus, even a rigid original will not be pushed back toward the reverse rollers 65*a* and 65*b* due to the elastic force of the original that has hit against the registration rollers 63*a* and 63*b* and bent.

Also, simultaneously with the start of rotation of the registration rollers 63*a* and 63*b* starting the transport of the original by the registration rollers 63*a* and 63*b*, the reverse roller electromagnetic clutch 77 is disengaged, rendering the reverse rollers 65*a* and 65*b* and the sheet discharge rollers 66*a* and 66*b* freely rotatable. Subsequently, the coil 96 of the solenoid 75 is de-energized, separating the idler-side reverse rollers 65*b* from the driving-side reverse rollers 65*a*. Therefore, the transport of the original by the registration rollers 63*a* and 63*b* is started with the original hardly being pushed back toward the reverse rollers 65*a* and 65*b* due to the elastic force of the original that has hit against the registration rollers 63*a* and 63*b* and bent. The original is rapidly pulled out from the reverse rollers 65*a* and 65*b* and the sheet discharge rollers 66*a* and 66*b*.

By contrast, conventionally, the time point t3 at which the reverse roller electromagnetic clutch 77 is switched from the engaged state to the disengaged state is made to coincide with the time point t1 of stop of the transport motor 74. In this case, the reverse rollers 65*a* and 65*b* and the sheet discharge rollers 66*a* and 66*b* become capable of dragging the original at the time point t1. Therefore, the original is pushed back toward the reverse rollers 65*a* and 65*b* due to the elastic force of the original that has hit against the registration rollers 63*a* and 63*b* and bent, causing separation of the bottom edge of the original from the registration rollers 63*a* and 63*b*, by the time point t3 at which the rotation of the registration rollers 63*a* and 63*b* is started, causing jamming.

As described above, in the reversing original transport apparatus 42 of this embodiment, at the time point t3 at which the second elapse time Δt4 from the time point t2 of start of normal rotation of the transport motor 74 reaches the second specified time S2 (a fixed time=20 ms), i.e., at the timing at which the transport of the original by the registration rollers 63*a* and 63*b* has been started with reliability, the reverse roller electromagnetic latch 77 is disengaged, rendering the reverse rollers 65*a* and 65*b* and the sheet discharge rollers 66*a* and 66*b* freely rotatable. Therefore, the transport of the original by the registration rollers 63*a* and 63*b* is started with the original hardly being pushed back toward the reverse rollers 65*a* and 65*b* due to the elastic force of the original that has hit against the registration rollers 63*a* and 63*b* and bent. The original is rapidly pulled out from the reverse rollers 65*a* and 65*b* and the sheet discharge rollers 66*a* and 66*b*.

FIG. 12 is a diagram showing experiment data on the numbers of occurrences of jamming obtained by changing the timing of switching of the reverse roller electromagnetic clutch 77 from the engaged state to the disengaged state.

In the experiment, obtained are the numbers of times of jamming having occurred when thick and rigid originals (size: A4, basis weight: 200 g) are transported to the registration rollers 63*a* and 63*b* through the reverse transport path 67 in the reversing original transport apparatus 42. Also, the numbers of occurrences of jamming are obtained for the cases of setting the pixel density in the sub-scanning direction at 400 dpi (where the original transport speed is high) and at 600 dpi (where the original transport speed is low). For both cases, the number of times of jamming having occurred when ten originals are transported are obtained, and this is repeated three times (first to third) for each.

Also, the numbers of occurrences of jamming are obtained for the variations of the second specified time S2 from the time point t2 of start of normal rotation of the transport motor 74 until the time point t3 of switching of the reverse roller electromagnetic clutch 77 from the engaged state to the disengaged state, 0 ms, 5 ms, 10 ms, 20 ms, and 30 ms.

The first specified time S1 (=10 ms) from the time point t1 of stop of the transport motor 74 until the timing at which the registration roller electromagnetic clutch 76 is engaged is kept at a fixed value. Also, the third specified time S3 (=30 ms) from the time point t2 of start of normal rotation of the transport motor 74 until time point t4 at which the coil 96 of the solenoid 75 is de-energized to separate the reverse rollers 65*a* and 65*b* from each other is kept at a fixed value.

As is apparent from the diagram of FIG. 12, the number of occurrences of jamming is largest when the second specified time S2 is set at 0 ms to make the time point t3 of switching of the reverse roller electromagnetic clutch 77 to the disengaged state coincide with the time point t2 of start of normal rotation of the transport motor 74, for both the cases of setting the pixel density in the sub-scanning direction at 400 dpi and at 600 dpi. The number of occurrences of jamming widely decreases to one when the second specified time S2 is set at 5 ms to delay the time point t3 of switching of the reverse roller electromagnetic clutch 77 to the disengaged state behind the time point t2 by 5 ms. Further, the number of occurrences of jamming is zero when the second specified time S2 is set at 10 ms, 20 ms, and 30 ms to delay the time point t3 behind the time point t2 by 10 ms, 20 ms, and 30 ms, respectively.

From the experiment results described above, it is found that, by delaying the time point t3 of switching of the reverse roller electromagnetic clutch 77 to the disengaged state behind the time point t2 of start of normal rotation of the transport motor 74 by a given length of time, no jamming occurs for even a thick and rigid original.

Note that, if the time point t3 of switching of the reverse roller electromagnetic clutch 77 to the disengaged state is widely delayed, the period during which the reverse roller electromagnetic clutch 77 is kept engaged after the start of normal rotation of the transport motor 74 will be long, causing the reverse rollers 65*a* and 65*b* to start rotating in the forward direction. Since the registration rollers 63*a* and 63*b* also start rotating in the forward direction roughly simultaneously, the bottom edge and top edge of the original will be transported in the opposite directions by the registration rollers 63*a* and 63*b* and the reverse rollers 65*a* and 65*b*. However, at the time point t2 of start of normal rotation of the transport motor 74, the top edge of the original has hit against the registration rollers 63*a* and 63*b*, forming a bend of the original. As far as this bend of the original is not cleared, even if the top edge of the original is transported and pulled by the reverse rollers 65*a* and 65*b*, the original will be pulled out from the reverse rollers 65*a* and 65*b* by the registration rollers 63*a* and 63*b* if only the reverse roller electromagnetic clutch 77 is switched from the engaged state to the disengaged state immediately after the pulling by the reverse rollers 65*a* and 65*b*. No trouble will therefore occur in the reverse transport of the original. Therefore, the second specified time S2 (fixed time) that determines the time point t3 of switching of the reverse roller electromagnetic clutch 77 to the disengaged state can be set at a value within the sum of the time lag from the time point t2 of start of normal rotation of the transport motor 74 until the start of rotation of the reverse rollers 65*a* and 65*b* and the sheet discharge rollers 66*a* and 66*b* and the time from the start of rotation of the reverse rollers 65*a* and 65*b* and the sheet discharge rollers 66*a* and 66*b* until the bend of the original having hit against the registration rollers 63*a* and 63*b* is cleared as the maximum.

The reversing sheet transport apparatus of the present invention can be applied, not only to the reversing original transport apparatus 42 that transports an original, but also to transporting of a recording sheet. For example, when the sheet registration rollers 34 and the sheet discharge rollers 36 in the image forming apparatus 1 of FIG. 1 are rotationally driven by a single motor and the rotation of the motor is conveyed to the sheet registration rollers 34 and the sheet discharge rollers 36 via respective electromagnetic clutches, the reversing sheet transport apparatus of the present invention can be used. Further, the present invention is not limited to the reversing sheet transport apparatus, but also includes the image forming apparatus.

While the preferred embodiment of the present invention has been described with reference to the accompanying drawings, it is to be understood that the present invention is not limited to this embodiment. It is obvious to those skilled in the art that various changes and modifications may be made within the scope of the appended claims, and all such changes and modifications should be construed as falling within the technical scope of the present invention.

What is claimed is:

1. A reversing sheet transport apparatus comprising:

registration rollers configured to transport a sheet of paper after an edge of the sheet has hit against the registration rollers;

reverse rollers configured to transport the sheet, placed downstream of the registration rollers in a sheet transport direction;

a single transport motor configured to rotationally drive the registration rollers and the reverse rollers;

a registration roller clutch configured to permit or block conveyance of rotation of the transport motor to rotation of the registration rollers; and a reverse roller clutch configured to permit or block conveyance of rotation of the transport motor to rotation of the reverse rollers, the transport motor being switched from forward rotation to reverse rotation midway through transport of the sheet in the sheet transport direction by the reverse rollers, to transport the sheet back to the registration rollers by the reverse rollers, and then being switched from reverse rotation to forward rotation to transport the sheet again in the sheet transport direction by the registration rollers, wherein the apparatus further comprises a control section configured to switch the registration roller clutch from a disengaged state to an engaged state so as to permit conveyance of rotation of the transport motor to rotation of the registration rollers during switching of the transport motor from reverse rotation to forward rotation, and switch the reverse roller clutch from the engaged state to the disengaged state so as to block conveyance of rotation of the transport motor to rotation of the reverse rollers after the lapse of a given length of time from a time point of start of forward rotation of the transport motor.

2. The reversing sheet transport apparatus of claim 1, wherein the given length of time corresponds to the time from the time point of start of forward rotation of the transport motor until start of rotation of the reverse rollers.

3. The reversing sheet transport apparatus of claim 2, wherein when the reverse roller clutch is in the disengaged state, the reverse rollers drag the sheet being transported.

4. The reversing sheet transport apparatus of claim 2, wherein the registration rollers transport the sheet through a sheet transport path toward the reverse rollers in the sheet transport direction, the reverse rollers transport the sheet through a reverse transport path toward upstream of the registration rollers in the sheet transport direction, and the registration rollers transport again the sheet through the sheet transport path toward the reverse rollers in the sheet transport direction, to reverse the side of the sheet.

5. The reversing sheet transport apparatus of claim 2, wherein the reverse rollers include a drive roller and an idler roller, the apparatus further comprises a switching drive section configured to switch either one of the drive roller and the idler roller between a pressed state against the other roller and a separated state from the other roller, and the control section controls the switching drive section to switch the reverse rollers from the pressed state to the separated state simultaneously with or after the switching of the reverse roller clutch from the engaged state to the disengaged state.

6. The reversing sheet transport apparatus of claim 2, further comprising:

sheet discharge rollers configured to transport the sheet at positions downstream of the reverse rollers in the sheet transport direction; and a rotation conveying section configured to convey rotation of the reverse rollers to rotation of the sheet discharge rollers.

7. The reversing sheet transport apparatus of claim 2, wherein a stop period during which the transport motor is at rest is provided between the reverse rotation and the forward rotation of the transport motor, and the control section switches the registration roller clutch from the disengaged state to the engaged state during the stop period.

8. An image forming apparatus comprising the reversing sheet transport apparatus of claim 2, wherein an original or a recording sheet is transported by the reversing sheet transport apparatus.

9. The reversing sheet transport apparatus of claim 1, wherein when the reverse roller clutch is in the disengaged state, the reverse rollers drag the sheet being transported.

10. The reversing sheet transport apparatus of claim 1, wherein the registration rollers transport the sheet through a sheet transport path toward the reverse rollers in the sheet transport direction, the reverse rollers transport the sheet through a reverse transport path toward upstream of the registration rollers in the sheet transport direction, and the registration rollers transport again the sheet through the sheet transport path toward the reverse rollers in the sheet transport direction, to reverse the side of the sheet.

11. The reversing sheet transport apparatus of claim 1, wherein the reverse rollers include a drive roller and an idler roller, the apparatus further comprises a switching drive section configured to switch either one of the drive roller and the idler roller between a pressed state against the other roller and a separated state from the other roller, and the control section controls the switching drive section to switch the reverse rollers from the pressed state to the separated state simultaneously with or after the switching of the reverse roller clutch from the engaged state to the disengaged state.

12. The reversing sheet transport apparatus of claim 1, further comprising:

sheet discharge rollers configured to transport the sheet at positions downstream of the reverse rollers in the sheet transport direction; and a rotation conveying section configured to convey rotation of the reverse rollers to rotation of the sheet discharge rollers.

13. The reversing sheet transport apparatus of claim 1, wherein a stop period during which the transport motor is at rest is provided between the reverse rotation and the forward rotation of the transport motor, and the control section switches the registration roller clutch from the disengaged state to the engaged state during the stop period.

14. An image forming apparatus comprising the reversing sheet transport apparatus of claim 1, wherein an original or a recording sheet is transported by the reversing sheet transport apparatus.

* * * * *